US007150052B1

(12) United States Patent
Lawson et al.

(10) Patent No.: US 7,150,052 B1
(45) Date of Patent: Dec. 19, 2006

(54) PORTABLE DOME COVER FOR CRIBS AND THE LIKE

(76) Inventors: Keith D. Lawson, 4936 Sweetwood Dr., El Sobrante, CA (US) 94803; Cindy E. Lawson, 4936 Sweetwood Dr., El Sobrante, CA (US) 94803

( * ) Notice: Subject to any disclaimer, the term of this patent is extended or adjusted under 35 U.S.C. 154(b) by 0 days.

(21) Appl. No.: 11/255,638

(22) Filed: Oct. 24, 2005

(51) Int. Cl.
*A47C 29/00* (2006.01)

(52) U.S. Cl. ..... 5/97; 5/416

(58) Field of Classification Search ..... 5/100, 5/110, 113, 121, 128, 629, 97, 425, 429, 414, 5/416
See application file for complete search history.

(56) References Cited

U.S. PATENT DOCUMENTS

| | | | | | |
|---|---|---|---|---|---|
| 217,632 | A | * | 7/1879 | McKeever | 5/97 |
| 467,035 | A | * | 1/1892 | Livingston | 312/50 |
| 1,594,256 | A | * | 7/1926 | Greene | 5/97 |
| 1,948,048 | A | * | 2/1934 | Riley | 5/97 |
| 2,035,343 | A | * | 3/1936 | Riley | 5/97 |
| 2,579,964 | A | * | 12/1951 | Reynolds | 219/526 |
| 2,673,989 | A | * | 4/1954 | Veitch | 5/97 |
| 2,820,468 | A | * | 1/1958 | Park et al. | 135/96 |
| 3,583,006 | A | * | 6/1971 | Oehms | 5/100 |
| 3,797,053 | A | | 3/1974 | Mamo | |
| 3,848,278 | A | * | 11/1974 | Propst | 5/603 |
| 4,043,349 | A | * | 8/1977 | Gays et al. | 135/137 |
| 4,359,792 | A | * | 11/1982 | Dale | 5/100 |
| 4,550,457 | A | * | 11/1985 | Dukkers | 5/414 |
| 4,825,484 | A | * | 5/1989 | Riegel | 5/97 |
| 4,945,584 | A | | 8/1990 | LaMantia | |
| 5,161,269 | A | | 11/1992 | McLean et al. | |
| D367,776 | S | * | 3/1996 | Lohroff | D6/433 |
| D367,788 | S | * | 3/1996 | Lawhorn | D6/491 |
| 6,109,280 | A | * | 8/2000 | Custer | 135/116 |
| 6,123,091 | A | | 9/2000 | Flynn et al. | |
| 6,227,635 | B1 | * | 5/2001 | Teppo et al. | 312/328 |
| D471,380 | S | * | 3/2003 | King et al. | D6/441 |

* cited by examiner

*Primary Examiner*—Patricia Engle
*Assistant Examiner*—Jonathan Liu

(57) ABSTRACT

A crib cover assembly includes a U-shaped central frame that includes an elongated cross bar and a pair of oppositely spaced end bars monolithically formed with the cross bar. The end bars are horizontally registered with opposed latitudinal edges of the crib and are abutted thereagainst. A pair of arcuately shaped guide rails are conjoined to the central frame and extend over and around the end bars. The guide rails form a pair of dome shaped regions over the central portion. The support and end bars are intercalated between a crib top edge and the guide rails. A retractable cover, that is adaptable between open and closed positions, is conjoined to the guide rails and is seated therebetween. The retractable cover has a longitudinal length spanning across an entire longitudinal length of the crib. The cover and the central frame are formed from wood.

18 Claims, 3 Drawing Sheets

PORTABLE DOME COVER FOR CRIBS AND THE LIKE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to crib covers and, more particularly, to a portable dome cover for cribs and the like.

2. Prior Art

Infants and children generally spend a large amount of time in pen-like structures, such as cribs. Parents place children in these structures for various reasons, like allowing the parent to attend other tasks or to get the infant to fall asleep, to name just a few. Because it is not practical to continually supervise a child in one of these structures, a number of safety devices were developed to prevent the child from climbing or falling out of the pen structure and sustaining an injury.

Although many of the prior art devices accomplish the intended task of retaining the child within the pen, there continues to be a number of inherent limitations in the design of such devices. For example, an inherent limitation of many prior art examples, however, is that the canopy lies directly perpendicular to the side walls of the pen. Therefore, the child or toddler has no headroom after reaching a certain height, and the useful life of such a device is severely limited. Furthermore, the means used to attach these canopy devices to the pen are cumbersome and impractical. Also, no convenient access means is provided for reaching the child or infant within the enclosure while keeping the canopy secured in place.

Another example discloses a frame-supported canopy for a crib. However, the patented apparatus is made strictly for environmental control of the enclosure and has a use limited to medical applications. The device is designed to strictly control the environment within the canopy enclosure, by preventing passage of oxygen and sound and restricting easy access to the infant. A further example discloses a canopy in the shape of a truncated pyramid, which may be attached to the top of a crib. This structure was designed to provide a safety canopy for use in transporting infants in medical environments. One limitation of this structure is that the canopy is made of a hard plastic material, thereby preventing access to the enclosure except by removing the canopy structure. Removal of the canopy structure requires operation of a special sliding track apparatus which retains the canopy on the crib.

Yet another example discloses a tent-like structure that is attachable to a mattress. Although this particular patent alleviates the problem of headroom for the occupant of the enclosure and does provide access to the enclosed area, the access is not convenient, the apparatus must be affixed to the mattress, and it provides no means for attachment to a playpen.

Accordingly, a need remains for a portable dome cover for cribs and the like in order to overcome the above-noted shortcomings. The present invention satisfies such a need by providing a crib cover that is easy to use, increases the infant or toddler's safety, and is practical in design. Such a cover has an easily retractable, sliding enclosure or canopy that is designed to keep an active baby or toddler from climbing out and possible falling. These types of falls frequently result in nasty bumps, bruises, and even head injuries and broken bones. In the most severe cases even death has occurred. With the crib cover a parent can rest assured that the child will not be able to climb out of the pen-like structure, while still having the freedom of movement to stand and move about. The slatted canopy also provides plenty of airflow and conveniently allows the parent to observe their child therethrough.

BRIEF SUMMARY OF THE INVENTION

In view of the foregoing background, it is therefore an object of the present invention to provide a portable dome cover for cribs and the like. These and other objects, features, and advantages of the invention are provided by a crib accessory for preventing infants from prematurely climbing out of a crib during unattended situations.

The crib accessory includes a U-shaped central frame suitably sized and shaped for uniformly fitting onto a perimeter of the crib. Such a central frame includes an elongated cross bar that has a longitudinal length horizontally registered with a longitudinal edge of the crib and directly abutted thereagainst. The central frame further includes a pair of oppositely spaced end bars monolithically formed with the cross bar that extended orthogonally away therefrom. Such end bars are horizontally registered with opposed latitudinal edges of the crib and are directly abutted thereagainst respectively. The end bars preferably remain statically affixed directly to the crib while the cover is biased between the open and closed positions.

A pair of arcuately shaped guide rails are directly conjoined to the central frame and extend over and around the end bars. Such guide rails form a pair of dome shaped regions over the central portion wherein each of the dome shaped regions has an apex medially situated between opposed ends of the end rails. The guide rails preferably travel downwardly along a rear side of the crib. The support bars and the end bars are statically intercalated between a top edge of the crib and the guide rails. Each guide rail may include a unitary and elongated groove extending along an inner surface thereof and along an entire longitudinal length of the guide rails respectively. The opposed ends of the slats are intercalated within the grooves respectively such that such slats are selectively biased along the grooves when the caregiver biases the slats along a path defined orthogonal to the longitudinal axis.

A retractable cover is adaptable between open and closed positions wherein the closed position advantageously and effectively prohibits the infant from escaping out of the crib and the open position conveniently allows a caregiver to access the infant housed within the crib. Such a retractable cover is directly conjoined to the guide rails and is seated therebetween wherein the retractable cover has a longitudinal length spanning across an entire longitudinal length of the crib. The cover and the central frame are formed from wood.

The retractable cover preferably includes a plurality of slats equidistantly spaced apart and has opposed ends directly connected to an inner face of the guide rails respectively. Such slats have longitudinal lengths spanning across the entire longitudinal length of the crib wherein the slats are coextensively shaped and define uniform openings therebetween. The slats are conveniently repeatedly adaptable between compressed and expanded positions when biased over the dome shaped regions. The assembly may further include a handle directly conjoined to a proximally disposed one of the slats such that the user can conveniently and effectively compress the slats along an accordion path wherein the slats become nested along a linear back side of the guide rails after being adapted to the open position. The handle preferably includes a quick-release latch removably nested directly into a corresponding notch for allowing the caregiver to easily close and lock the cover during unattended situations.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
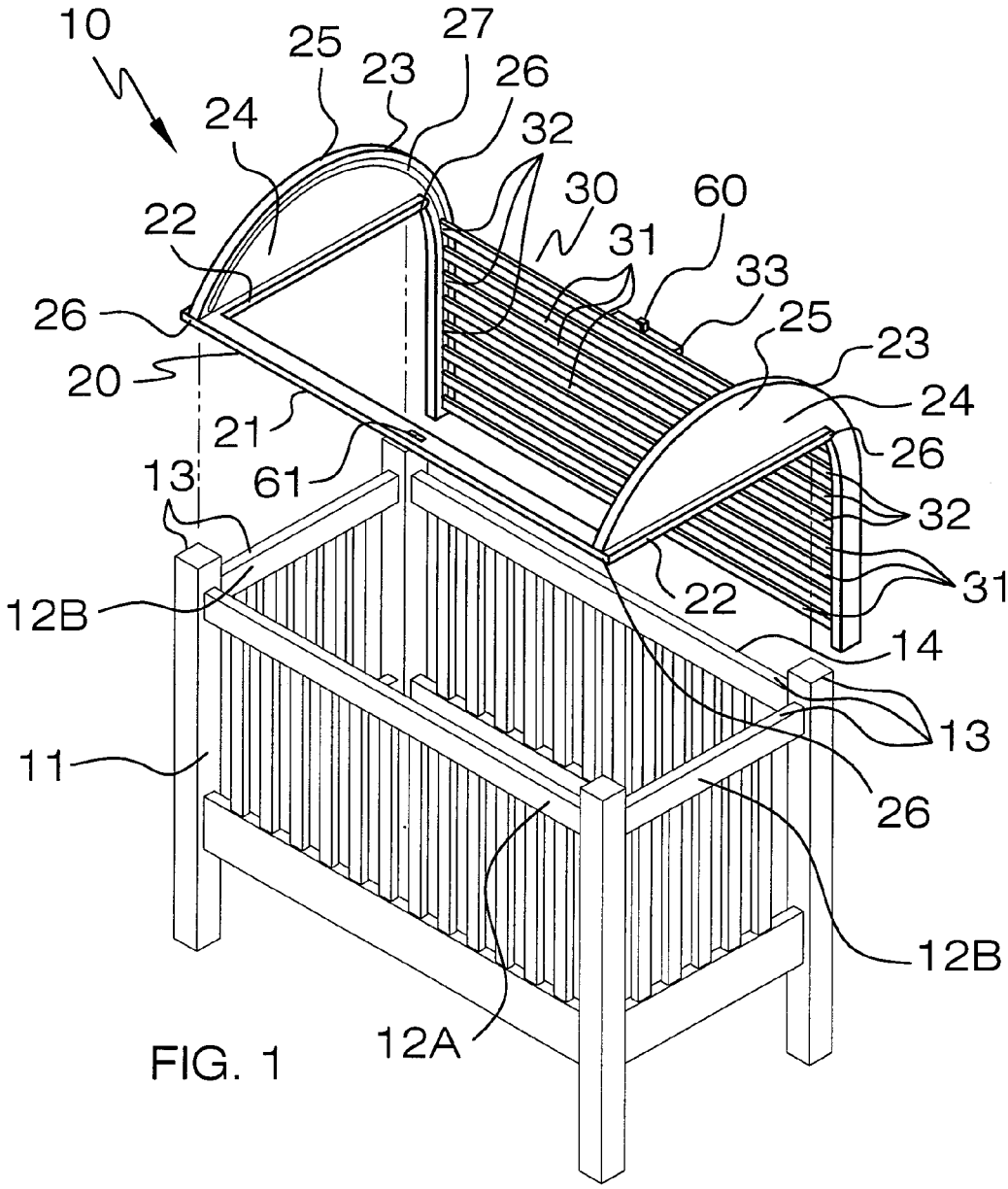
FIG. 1 is a perspective view showing a portable dome cover for cribs and the like, in accordance with the present invention.
Figure 2:
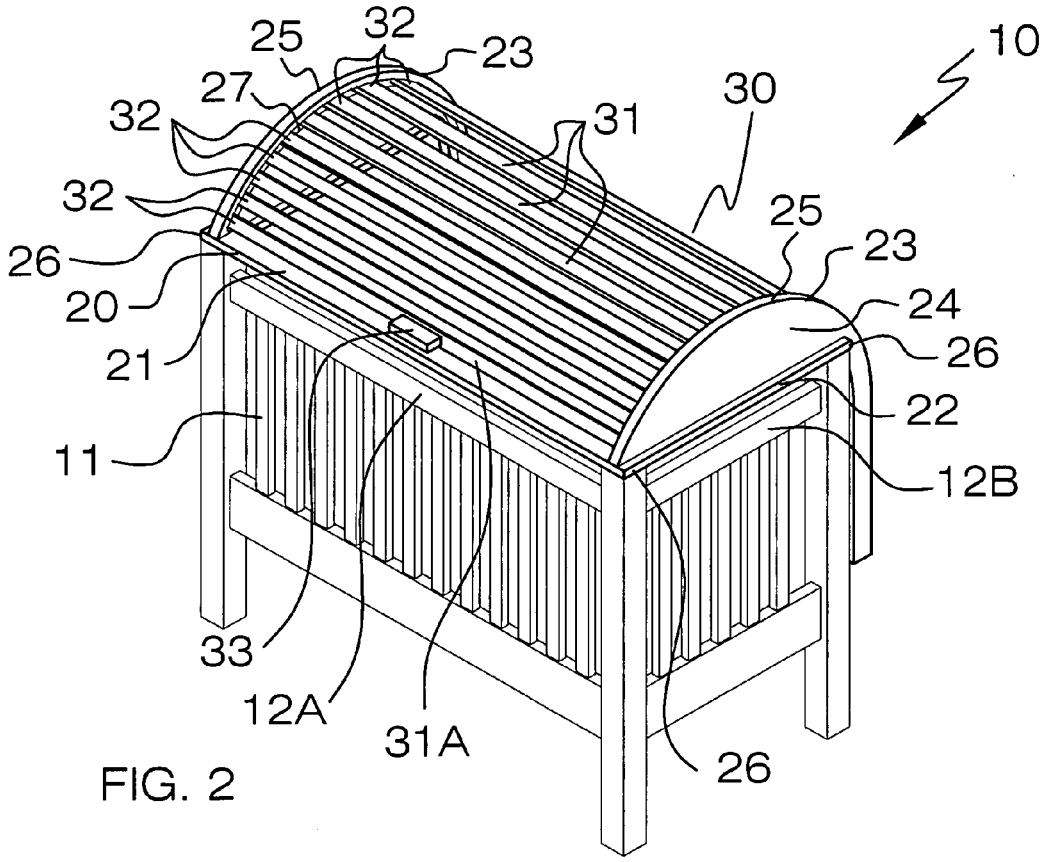
FIG. 2 is a perspective view of the assembly shown in FIG. 1, showing the cover directly positioned onto the crib structure.
Figure 3:
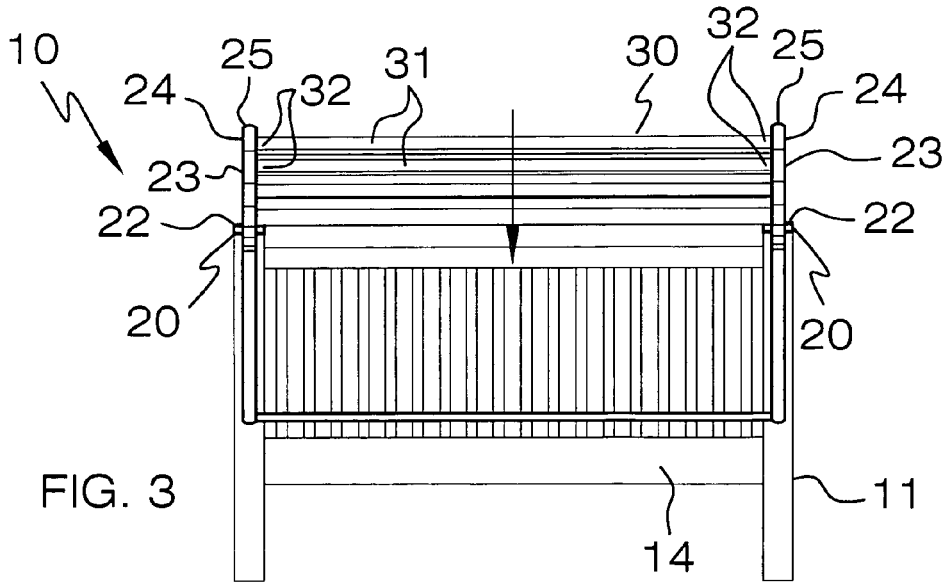
FIG. 3 is a rear-elevational view of the assembly shown in FIG. 2.
Figure 4:
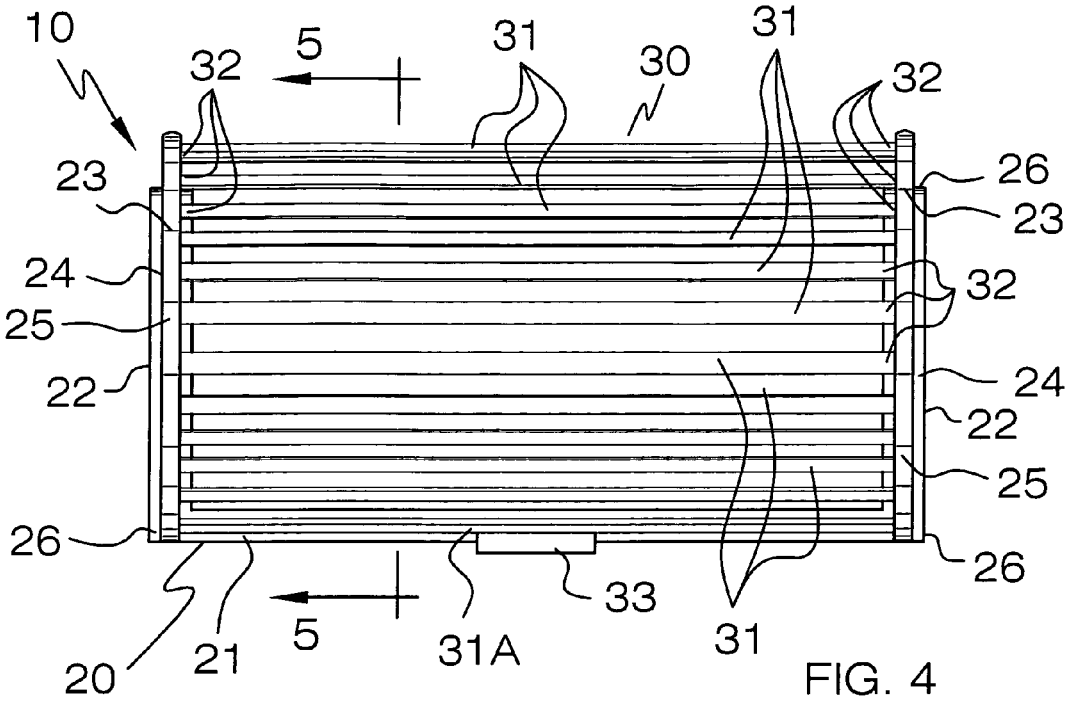
FIG. 4 is an enlarged top plan view of the assembly shown in FIG. 2.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–5 by the reference numeral 10 and is intended to provide a portable dome cover for cribs and the like. It should be understood that the assembly 10 may be used to cover many different types of pen-like structures and should not be limited in use to only covering an infant's crib. Furthermore, it is noted that the present invention may be monolithically formed with a crib 11 for providing a combined assembly 10 and crib 11 such that the assembly 10 cannot be removed from the crib 11, for example.

Referring initially to FIGS. 1, 2, 3 and 5, the assembly 10 includes a U-shaped central frame 20 suitably sized and shaped for uniformly fitting onto a perimeter of the crib 11. Of course, the central frame 20 may be produced in a variety of shapes and sizes so as to effectively fit on alternately shaped cribs, as is obvious to a person of ordinary skill in the art. Such a central frame 20 includes an elongated cross bar 21 that has a longitudinal length horizontally registered with a longitudinal edge 12A of the crib 11 and is directly abutted, without the use of intervening elements, thereagainst.

The central frame 20 further includes a pair of oppositely spaced end bars 22 monolithically formed with the cross bar 21 that extended orthogonally away therefrom. Of course, the cross bar 21 and the end bars 22 can be statically affixed to a top surface 13 of the crib with conventional fastening members (not shown) in order to advantageously prevent a displacement of the assembly 10 from the crib, as is obvious to a person of ordinary skill in the art. Such end bars 22 are horizontally registered with opposed latitudinal edges 12B of the crib 11 and are directly abutted, without the use of intervening elements, thereagainst respectively. The end bars 22 advantageously and effectively remain statically affixed directly, without the use of intervening elements, to the crib 11 while the cover 30 (described herein below) is biased between the open and closed positions.

Figure 5:
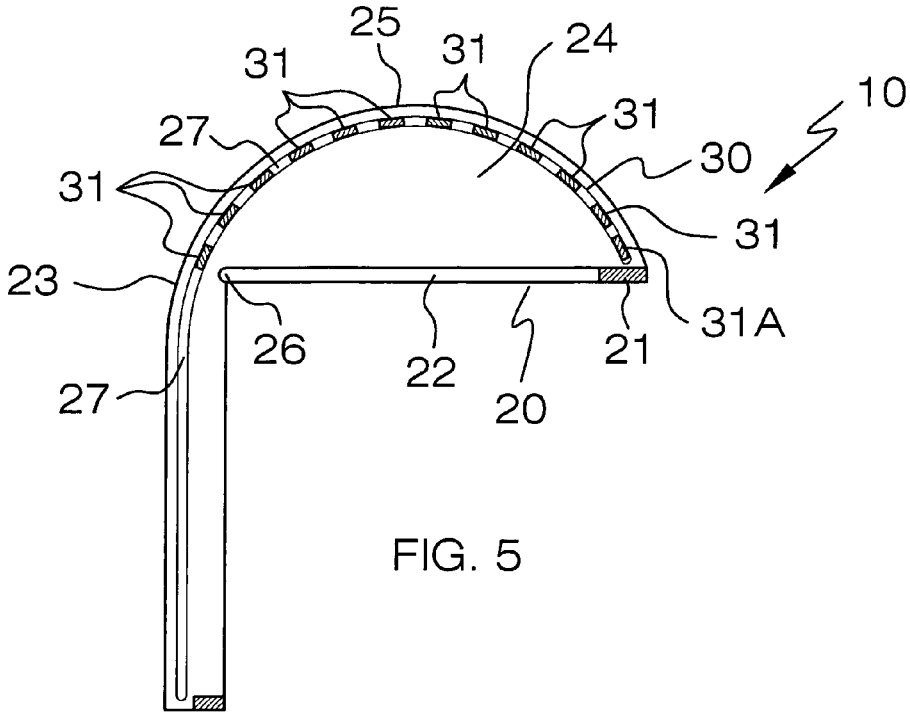
FIG. 5 is a cross-sectional view of the assembly shown in FIG. 4, taken along line 5—5.

Referring to FIGS. 1, and 5, a pair of arcuately shaped guide rails 23 are directly conjoined, without the use of intervening elements, to the central frame 20 and extend over and around the end bars 22. The arcuate shape of the guide rails 23 is important for causing the cover 30 to be positioned above the top surface 13 of the crib 11 when closed, which advantageously allows an infant or toddler to stand within the crib 11 while the cover 30 is biased to a closed position. Such guide rails 23 form a pair of dome shaped regions 24 over the central frame 20 wherein each of the dome shaped regions 24 has an apex 25 medially situated between opposed ends 26 of the end bars 22. The guide rails 23 travel downwardly along a rear side 14 of the crib 11.

The cross bar 21 and the end bars 22 are statically intercalated between a top edge 13 of the crib 11 and the guide rails 23. Each guide rail 23 includes a unitary and elongated groove 27 extending along an inner surface thereof and along an entire longitudinal length of the guide rails 23 respectively. The opposed ends 32 of the slats 31 (described herein below) are intercalated within the grooves 27 respectively, which is essential such that the slats 31 are selectively and effectively biased along the grooves 27 when the caregiver biases the slats 31 along a path defined orthogonal to the longitudinal axis.

Referring to FIGS. 1 through 5, a retractable cover 30 is adaptable between open and closed positions wherein the closed position advantageously and effectively prohibits the infant from escaping out of the crib 11 and the open position conveniently allows a caregiver to access the infant housed within the crib 11. Such a retractable cover 30 is directly conjoined, without the use of intervening elements, to the guide rails 23 and is seated therebetween wherein the retractable cover 30 has a longitudinal length spanning across an entire longitudinal length of the crib 11. This is an important feature for ensuring that at the closed position no opening is left along the top surface 13 where the infant can exit and possibly fall from the crib 11. The cover 30 and the central frame 20 are formed from wood. Of course, the cover 30 and the frame 20 may be produced from any other suitable materials, like a durable plastic, as is obvious to a person of ordinary skill in the art.

Still referring to FIGS. 1 through 5, the retractable cover 30 includes a plurality of slats 31 equidistantly spaced apart that have opposed ends 32 directly connected, without the use of intervening elements, to an inner face of the guide rails 23 respectively. Such slats 31 have longitudinal lengths spanning across the entire longitudinal length of the crib 11 wherein the slats 31 are coextensively shaped and define uniform openings therebetween. Such openings are advantageous and vital for allowing an ample amount of airflow to pass therethrough and also for allowing a parent to conveniently observe their child through the assembly 10 when the cover 30 is biased to a closed position.

The slats 31 are conveniently repeatedly adaptable between compressed and expanded positions when biased over the dome shaped regions. The assembly 10 further includes a handle 33 directly conjoined, without the use of intervening elements, to a proximally disposed one 31A of the slats 31, which is crucial such that the user can conveniently and effectively compress the slats 31 along an accordion path wherein the slats 31 become nested along a linear back side of the guide rails 23 after being adapted to the open position. The handle 33 includes a quick-release latch 60 removably nested directly into a corresponding notch 61 for allowing the caregiver to easily close and lock the cover 30 during unattended situations.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A crib accessory for preventing infants from prematurely climbing out of a crib during unattended situations, said crib accessory comprising;

a U-shaped central frame seated directly on top perimeter of the crib, said central frame including an elongated cross bar having a longitudinal length horizontally registered with a longitudinal edge of the crib and directly abutted thereagainst, said central frame further including a pair of oppositely spaced end bars monolithically formed with said cross bar and extended orthogonally away therefrom, said end bars being horizontally registered with opposed latitudinal edges of the crib and directly abutted thereagainst respectively;

a pair of arcuately shaped guide rails directly conjoined to said central frame and extending over and around said end bars, said guide rails forming a pair of dome shaped regions over said central frame wherein each said dome shaped regions have an apex medially situated between opposed ends of said end rails; and a retractable cover adaptable between open and closed positions wherein the closed position prohibits the infant from escaping out of the crib and the open position allows a caregiver to access the infant housed within the crib, said retractable cover being directly conjoined to said guide rails and seated therebetween wherein said retractable cover has a longitudinal length spanning across an entire longitudinal length of the crib;

wherein each of said guide rails have unitary bodies provided with solid planar sides such that the infant cannot exit through said guide rails, said guide rails having coextensively shaped linear portions and coextensively shaped arcuate portions monolithically formed therewith respectively, said arcuate portions having respective diameters equal to a longitudinal length of said end bars, said linear portions traveling linearly and downwardly along a rear side of the crib;

wherein the longitudinal lengths of said linear portions are substantially equal to the diameters of said arcuate portions respectively.

2. The assembly of claim 1, wherein said retractable cover comprises:

a plurality of slats equidistantly spaced apart and having opposed ends directly connected to an inner face of said guide rails respectively, said slats having longitudinal lengths spanning across the entire longitudinal length of the crib wherein said slats are coextensively shaped and define uniform openings therebetween, said slats being repeatedly adaptable between compressed and expanded positions when biased over said dome shaped regions.

3. The assembly of claim 1, further comprising:

a handle directly conjoined to a proximally disposed one of said slats such that the user can compress said slats along an accordion path wherein said slats become nested along a linear back side of said guide rails after being adapted to the open position.

4. The assembly of claim 1, wherein each said guide rail includes a unitary and elongated groove extending along an inner surface thereof and along an entire longitudinal length of said guide rails respectively, said opposed ends of said slats being intercalated within said grooves respectively such that such slats are selectively biased along said grooves when the caregiver biases said slats along a path defined orthogonal to the longitudinal axis.

5. The assembly of claim 1, wherein said end bars remains statically affixed directly to the crib while said cover is biased between the open and closed positions.

6. The assembly of claim 1, wherein said guide rails travel downwardly along a rear side of the crib.

7. A crib accessory for preventing infants from prematurely climbing out of a crib during unattended situations, said crib accessory comprising:

a U-shaped central frame seated directly on top perimeter of the crib, said central frame including an elongated cross bar having a longitudinal length horizontally registered with a longitudinal edge of the crib and directly abutted thereagainst, said central frame further including a pair of oppositely spaced end bars monolithically formed with said cross bar and extended orthogonally away therefrom, said end bars being horizontally registered with opposed latitudinal edges of the crib and directly abutted thereagainst respectively;

a pair of arcuately shaped guide rails directly conjoined to said central frame and extending over and around said end bars, said guide rails forming a pair of dome shaped regions over said central frame wherein each said dome shaped regions have an apex medially situated between opposed ends of said end rails; and a retractable cover adaptable between open and closed positions wherein the closed position prohibits the infant from escaping out of the crib and the open position allows a caregiver to access the infant housed within the crib, said retractable cover being directly conjoined to said guide rails and seated therebetween wherein said retractable cover has a longitudinal length spanning across an entire longitudinal length of the crib, wherein said cover and said central frame are formed from wood;

wherein each of said guide rails have unitary bodies provided with solid planar sides such that the infant cannot exit through said guide rails, said guide rails having coextensively shaped linear portions and coextensively shaped arcuate portions monolithically formed therewith respectively, said arcuate portions having respective diameters equal to a longitudinal length of said end bars, said linear portions traveling linearly and downwardly along a rear side of the crib;

wherein the longitudinal lengths of said linear portions are substantially equal to the diameters of said arcuate portions respectively.

8. The assembly of claim 7, wherein said retractable cover comprises:

a plurality of slats equidistantly spaced apart and having opposed ends directly connected to an inner face of said guide rails respectively, said slats having longitudinal lengths spanning across the entire longitudinal length of the crib wherein said slats are coextensively shaped and define uniform openings therebetween, said slats being repeatedly adaptable between compressed and expanded positions when biased over said dome shaped regions.

9. The assembly of claim 7, further comprising:

a handle directly conjoined to a proximally disposed one of said slats such that the user can compress said slats along an accordion path wherein said slats become nested along a linear back side of said guide rails after being adapted to the open position.

10. The assembly of claim 7, wherein each said guide rail includes a unitary and elongated groove extending along an inner surface thereof and along an entire longitudinal length of said guide rails respectively, said opposed ends of said slats being intercalated within said grooves respectively such that such slats are selectively biased along said grooves when the caregiver biases said slats along a path defined orthogonal to the longitudinal axis.

11. The assembly of claim 7, wherein said end bars remains statically affixed directly to the crib while said cover is biased between the open and closed positions.

12. The assembly of claim 7, wherein said guide rails travel downwardly along a rear side of the crib.

13. A crib accessory for preventing infants from prematurely climbing out of a crib during unattended situations, said crib accessory comprising:

a U-shaped central frame seated directly on top perimeter of the crib, said central frame including an elongated cross bar having a longitudinal length horizontally registered with a longitudinal edge of the crib and directly abutted thereagainst, said central frame further including a pair of oppositely spaced end bars monolithically formed with said cross bar and extended orthogonally away therefrom, said end bars being horizontally registered with opposed latitudinal edges of the crib and directly abutted thereagainst respectively;

a pair of arcuately shaped guide rails directly conjoined to said central frame and extending over and around said end bars, said guide rails forming a pair of dome shaped regions over said central frame wherein each said dome shaped regions have an apex medially situated between opposed ends of said end rails, wherein said support bars and said end bars are statically intercalated between a top edge of the crib and said guide rails; and a retractable cover adaptable between open and closed positions wherein the closed position prohibits the infant from escaping out of the crib and the open position allows a caregiver to access the infant housed within the crib, said retractable cover being directly conjoined to said guide rails and seated therebetween wherein said retractable cover has a longitudinal length spanning across an entire longitudinal length of the crib, wherein said cover and said central frame are formed from wood;

wherein each of said guide rails have unitary bodies provided with solid planar sides such that the infant cannot exit through said guide rails, said guide rails having coextensively shaped linear portions and coextensively shaped arcuate portions monolithically formed therewith respectively, said arcuate portions having respective diameters equal to a longitudinal length of said end bars, said linear portions traveling linearly and downwardly along a rear side of the crib;

wherein the longitudinal lengths of said linear portions are substantially equal to the diameters of said arcuate portions respectively.

14. The assembly of claim 13, wherein said retractable cover comprises:

a plurality of slats equidistantly spaced apart and having opposed ends directly connected to an inner face of said guide rails respectively, said slats having longitudinal lengths spanning across the entire longitudinal length of the crib wherein said slats are coextensively shaped and define uniform openings therebetween, said slats being repeatedly adaptable between compressed and expanded positions when biased over said dome shaped regions.

15. The assembly of claim 13, further comprising;

a handle directly conjoined to a proximally disposed one of said slats such that the user can compress said slats along an accordion path wherein said slats become nested along a linear back side of said guide rails after being adapted to the open position.

16. The assembly of claim 13, wherein each said guide rail includes a unitary and elongated groove extending along an inner surface thereof and along an entire longitudinal length of said guide rails respectively, said opposed ends of said slats being intercalated within said grooves respectively such that such slats are selectively biased along said grooves when the caregiver biases said slats along a path defined orthogonal to the longitudinal axis.

17. The assembly of claim 13, wherein said end bars remains statically affixed directly to the crib while said cover is biased between the open and closed positions.

18. The assembly of claim 1, wherein said guide rails travel downwardly along a rear side of the crib.

* * * * *